US010003145B1

(12) United States Patent
Annis et al.

(10) Patent No.: US 10,003,145 B1
(45) Date of Patent: Jun. 19, 2018

(54) ELECTRICAL CONNECTOR HAVING A CIRCUIT BOARD INTERPOSER WITH PRESS-FIT MOUNTING CONTACTS

(71) Applicant: TE CONNECTIVITY CORPORATION, Berwyn, PA (US)

(72) Inventors: Kyle Gary Annis, Hummelstown, PA (US); Keith Edwin Miller, Manheim, PA (US); Albert Tsang, Harrisburg, PA (US); Graham Harry Smith, Jr., Mechanicsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days. days.

(21) Appl. No.: 15/488,921

(22) Filed: Apr. 17, 2017

(51) Int. Cl.

| | |
|---|---|
| ***H01R 12/00*** | (2006.01) |
| ***H01R 12/71*** | (2011.01) |
| ***H01R 4/10*** | (2006.01) |
| ***H01R 12/70*** | (2011.01) |
| ***H01R 4/02*** | (2006.01) |

(52) U.S. Cl.
CPC ..... *H01R 12/716* (2013.01); *H01R 4/02* (2013.01); *H01R 4/10* (2013.01); *H01R 9/091* (2013.01); *H01R 9/096* (2013.01); *H01R 12/7082* (2013.01)

(58) Field of Classification Search
CPC . H01R 4/10; H01R 4/183; H01R 4/20; H01R 9/091; H01R 9/096; H01R 12/00; H01R 12/52; H01R 12/7082; H01R 12/7088; H01R 12/71; H01R 12/716; H01R 12/73; H01R 13/2435; H01R 4/18
USPC ..... 439/65, 66, 84
See application file for complete search history.

(56) References Cited

U.S. PATENT DOCUMENTS

| | | | | |
|---|---|---|---|---|
| 7,874,880 | B2 * | 1/2011 | Fedde | H01R 13/2471 439/66 |
| 8,535,065 | B2 * | 9/2013 | Costello | H01R 13/6585 439/607.03 |
| 2008/0239683 | A1 * | 10/2008 | Brodsky | H05K 7/1069 361/760 |
| 2009/0186495 | A1 * | 7/2009 | Taylor | H01R 12/714 439/66 |
| 2012/0058655 | A1 * | 3/2012 | Chien | H01R 12/585 439/78 |

* cited by examiner

*Primary Examiner* — Chandrika Prasad

(57) ABSTRACT

A press-fit circuit board connector including a housing and mating and mounting contact assemblies received in the housing. The mating contact assembly having mating contacts having mating pins defining a pin mating interface. The mounting contact assembly having an interposer circuit board and mounting contacts electrically connected to the interposer circuit board. The mounting contacts have press-fit mounting pins at mounting ends of the mounting contacts. The interposer circuit board is received in the cavity with the press-fit mounting pins of the mounting contacts arranged at the mounting end for press-fit termination to the host circuit board.

17 Claims, 7 Drawing Sheets

ELECTRICAL CONNECTOR HAVING A CIRCUIT BOARD INTERPOSER WITH PRESS-FIT MOUNTING CONTACTS

BACKGROUND OF THE INVENTION

The subject matter herein relates generally to circuit board connectors.

Electrical connectors provide communicative interfaces between electrical components where power and/or signals may be transmitted therethrough. For example, the electrical connectors may be used within telecommunication equipment, servers, and data storage or transport devices. Typically, electrical connectors are used in environments, such as in offices or homes, where the connectors are not subjected to constant shock, vibration, and/or extreme temperatures. However, in some applications, such as aerospace or military equipment, the electrical connector must be configured to withstand certain environmental conditions and still effectively transmit power and/or data signals.

In some applications, electrical connectors are electrically connected to circuit boards. The electrical connectors have solder tails that are soldered to the circuit board. Terminating the electrical connectors to the circuit board may be a time consuming and expensive process. For example, the electrical connector must be positioned relative to the circuit board and then the assembly is further processed to solder the solder tails to the circuit board. Furthermore, the circuit board interface may require that the contacts be arranged at a different pattern than the mating interface. For example, the circuit board may require particular spacing between the circuits for routing of the circuits.

Accordingly, there is a need for an electrical connector that offers alternative mounting to the circuit board to establish an electrical connection.

BRIEF DESCRIPTION OF THE INVENTION

In one embodiment, a press-fit circuit board connector is provided including a housing having a mating end and a mounting end opposite the mating end configured to be mounted to a host circuit board and having a cavity between the mating end and the mounting end. The circuit board connector includes a mating contact assembly having a mating contact holder including a plurality of contact channels and a plurality of mating contacts received in corresponding contact channels. The mating contacts have mating pins at mating ends of the mating contacts. The mating contact assembly is received in the cavity of the housing positioning the mating pins at the mating end to define a pin mating interface for mating with an electrical connector. The circuit board connector includes a mounting contact assembly having an interposer circuit board and a plurality of mounting contacts electrically connected to the interposer circuit board at corresponding circuits of the interposer circuit board. The mating contacts are electrically connected to corresponding circuits of the interposer circuit board to electrically connect the mating contacts and the mounting contacts via the interposer circuit board. The mounting contacts have press-fit mounting pins at mounting ends of the mounting contacts. The interposer circuit board is received in the cavity with the press-fit mounting pins of the mounting contacts arranged at the mounting end for press-fit termination to the host circuit board.

In another embodiment, a press-fit circuit board connector is provided including a housing having a mating end and a mounting end opposite the mating end configured to be mounted to a host circuit board and having a cavity between the mating end and the mounting end. The circuit board connector includes a mounting contact assembly received in the cavity having an interposer circuit board including an upper board surface and a lower board surface. The mounting contact assembly has a plurality of mounting contacts terminated to the lower board surface of the interposer circuit board at corresponding circuits of the interposer circuit board. The mounting contacts have press-fit mounting pins at mounting ends of the mounting contacts for press-fit termination to the host circuit board. The circuit board connector includes a mating contact assembly received in the cavity having a mating contact holder including a plurality of contact channels. The mating contact assembly has a plurality of mating contacts received in corresponding contact channels having mating pins at mating ends of the mating contacts for mating with an electrical connector and having terminating ends opposite the mating pins being electrically connected to the upper board surface of the interposer circuit board at corresponding circuits of the interposer circuit board to electrically connect the mating contacts and the mounting contacts via the interposer circuit board.

In a further embodiment, a press-fit circuit board connector is provided including a housing having a mating end and a mounting end opposite the mating end configured to be mounted to a host circuit board and having a cavity between the mating end and the mounting end. The circuit board connector includes a mounting contact assembly received in the cavity having an interposer circuit board including an upper circuit board, a lower circuit board and a flexible circuit between the upper circuit board and the lower circuit board. The mounting contact assembly has a plurality of mounting contacts electrically connected to the lower circuit board having press-fit mounting pins at mounting ends of the mounting contacts for press-fit termination to the host circuit board. The circuit board connector includes a mating contact assembly received in the cavity having a plurality of mating contacts having mating pins at mating ends of the mating contacts for mating with an electrical connector and terminating ends opposite the mating pins electrically connected to the upper circuit board. The flexible circuit electrically connects the mating contacts electrically connected to the upper circuit board with corresponding mounting contacts electrically connected to the lower circuit board.

DETAILED DESCRIPTION OF THE INVENTION

Figure 1:
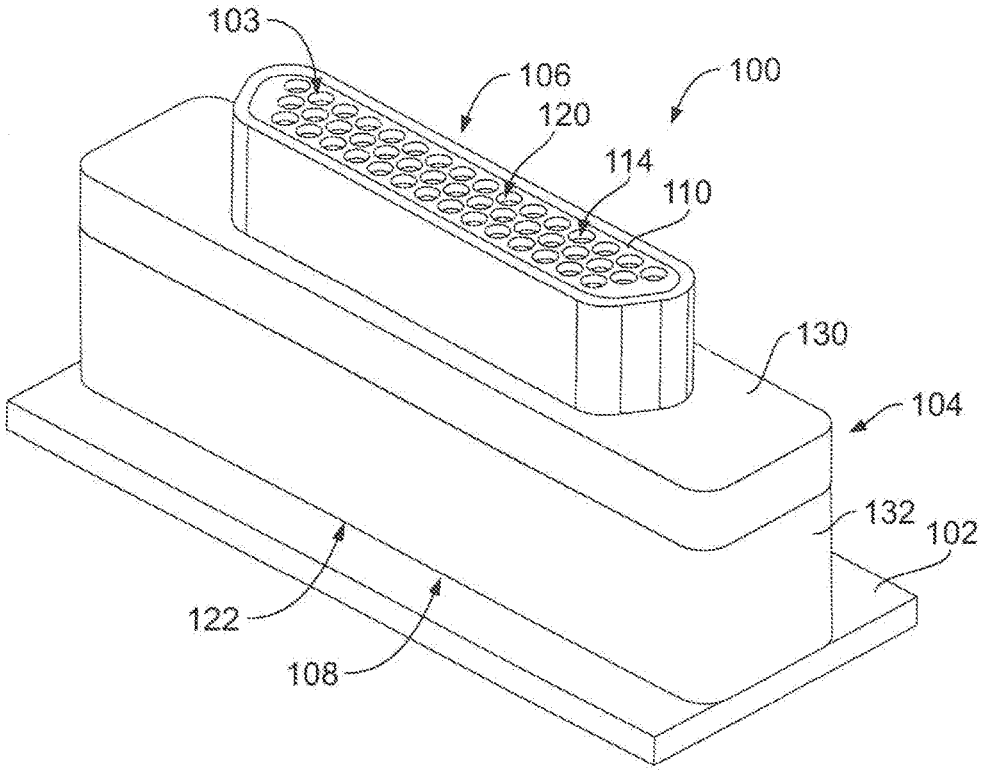
FIG. 1 is a perspective view of a press-fit circuit board connector formed in accordance with an exemplary embodiment including a contact assembly.
Figure 2:
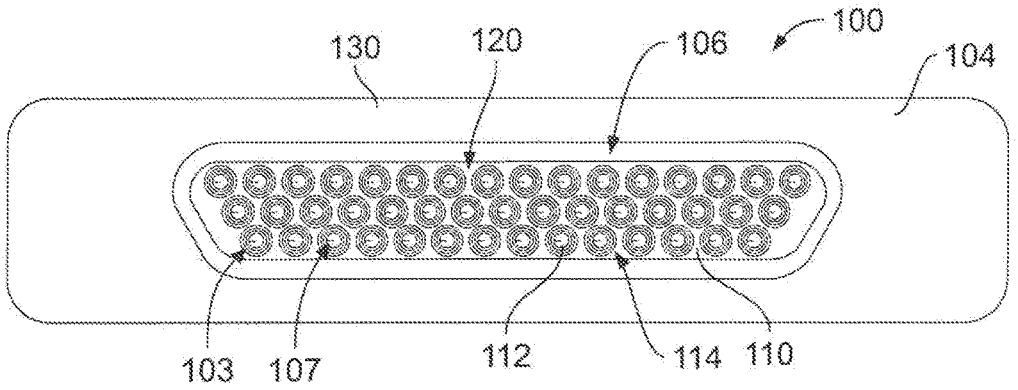
FIG. 2 is a top view of the circuit board connector.
Figure 3:
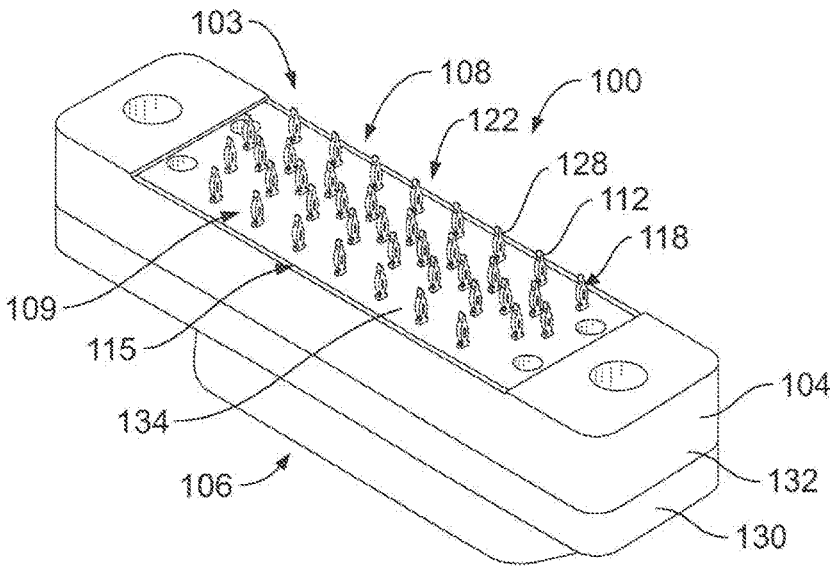
FIG. 3 is a rear perspective view of the circuit board connector.
Figure 4:
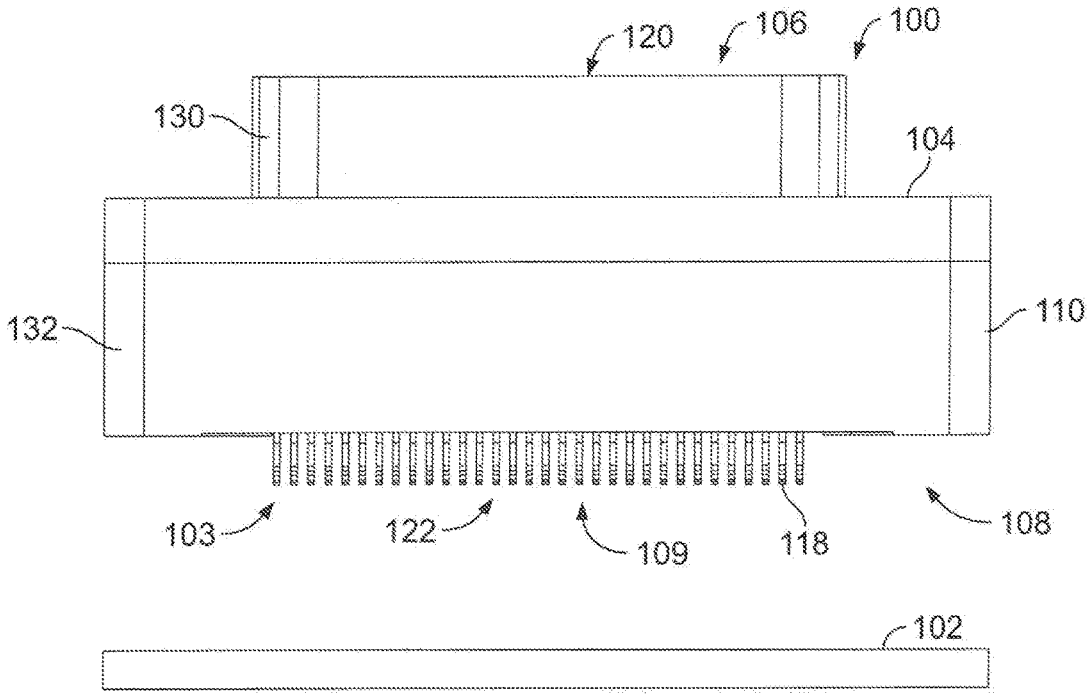
FIG. 4 is a side view of the circuit board connector.

FIG. 1 is a perspective view of a press-fit circuit board connector 100 formed in accordance with an exemplary embodiment mounted to a host circuit board 102. FIG. 2 is a top view of the circuit board connector 100. FIG. 3 is a rear perspective view of the circuit board connector 100 showing compliant pins configured to be press-fit to the host circuit board 102. FIG. 4 is a side view of the circuit board connector 100 poised for mounting to the host circuit board 102 showing the compliant pins for press-fit mounting the circuit board connector 100 to the host circuit board 102. The circuit board connector 100 includes a contact assembly 103 configured to be electrically connected to the host circuit board and configured for mating with a mating electrical connector.

The circuit board connector 100 includes a housing 104 holding the contact assembly 103. The housing 104 has a mating end 106 holding a mating contact assembly 107 of the contact assembly 103 and a mounting end 108 opposite the mating end 106 holding a mounting contact assembly 109 of the contact assembly 103. The mating end 106 is configured for mating with the mating electrical connector to electrically connect the mating contact assembly 107 with mating contacts of the electrical connector. The mounting end 108 is configured for mounting to the host circuit board 102 for terminating the mounting contact assembly 109 with the host circuit board 102. In an exemplary embodiment, the circuit board connector 100 defines a vertical board-to-board connector configured to mate with the corresponding mating connector between two circuit boards that are oriented parallel to each other; however other types of connectors may be used in alternative embodiments, such as a right-angle connector. In the illustrated embodiment, the mating end 106 defines a plug configured to be mated with a mating electrical connector; however, the mating end 106 may define a receptacle in alternative embodiments.

The mating contact assembly 107 has a contact holder 110 holding a plurality of mating contacts 112 (FIG. 2). The contact holder 110 includes a plurality of contact channels 114 receiving corresponding mating contacts 112. In the illustrated embodiment, at the mating end 106 (FIG. 2), the contact channels 114 are cylindrical openings with the mating contacts 112 arranged therein. The contact channels 114 may receive corresponding mating contacts of the mating electrical connector at the mating end 106. The contact holder 110 is held in a cavity 115 of the housing 104.

Figure 5:
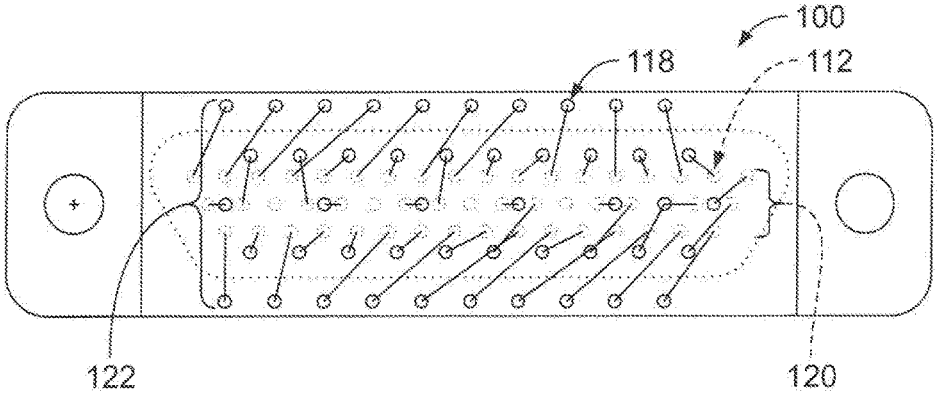
FIG. 5 is a bottom view of the circuit board connector.

The mounting contact assembly 109 includes an interposer circuit board 116 (shown in FIG. 5) and a plurality of mounting contacts 118 electrically connected or terminated to the interposer circuit board 116. The mating contacts 112 are electrically connected or terminated to the interposer circuit board 116 and electrically connected to corresponding mounting contacts 118 via the interposer circuit board 116. The interposer circuit board 116 includes circuits interconnecting the contacts 112, 118. In an exemplary embodiment, the interposer circuit board 116 routes the circuits to dedicated locations to change the interfaces of the contacts 112, 118 between the mating end 106 and the mounting end 108. For example, the mating contacts 112 may have a different pattern or orientation at the mating end 106 than the mounting contacts 118 at the mounting end 108. For example, FIG. 5 is a bottom view of the circuit board connector 100 showing the pattern of the mounting contacts 118 and showing the pattern of the mating contacts 112 in phantom with connecting lines illustrating the signal paths between the mounting contacts 118 and the mating contacts 112.

With additional reference back to FIGS. 1-4, in an exemplary embodiment, the mating contacts 112 are arranged at the mating end 106 to define a pin mating interface 120 having a first pattern and the mounting contacts 118 are arranged at the mounting end 108 to define a pin mounting interface 122 having a second pattern different than the first pattern. For example, the mounting contacts 118 at the pin mounting interface 122 have a pattern that is more spread out than the mating contacts 112 at the pin mating interface 120. For example, the mounting contacts 118 may be spread out to fit on the host circuit board 102. Space may be needed on the circuit board 102 for plated through holes and/or for routing traces. The pin mating interface 120 may be designed to meet a particular standard, such as MIL-DTL-83513, or other standards, for intermateability, interchangeability and performance of a particular connector series. For example, in an exemplary embodiment, the circuit board connector 100 is a micro-D connector. In the illustrated embodiment, the mating contacts 112 at the pin mating interface 120 are arranged in first, second, and third rows, whereas the mounting contacts 118 at the pin mounting interface 122 are arranged in more than three rows, such as, fourth, and fifth, sixth, seventh, and eighth rows, allowing the mounting contacts 118 to have a larger center line spacing between adjacent mounting contacts 118 as compared to the center line spacing of the mating contacts 112. Optionally, the mounting contacts 118 at the pin mounting interface 122 are arranged in two sets of triangular groups with mounting contacts 118 in the fourth and fifth rows forming triangular groups and with mounting contacts 118 in the seventh and eighth rows defining triangular groups. The sixth row of mounting contacts 118 is centrally located between these two triangular groups. In other various embodiments, the pin mating interface 120 may have more than three rows, such as four rows and the pin mounting interface 122 may have more than five rows, such as six rows. In other various embodiments, the mating and mounting interfaces 120, 122 may have the same pattern and/or spacing of pins, such as a 0.05" triangular grid at both ends.

In an exemplary embodiment, the mounting contacts 118 define press-fit mounting pins at the mounting end 108 that are compliant and configured for press-fit mechanical and electrical connection to the circuit board 102. For example, the mounting contacts 118 may be eye-of-the-needle pins. In an exemplary embodiment, the mating contacts 112 may define mating pins or mating sockets defining a separable mating interface configured for repeated mating and unmating with corresponding mating contacts of the mating electrical connector. Although in the illustrated embodiments the mounting contacts 118 are press-fit mounting pins, in alternate embodiments the mounting contacts 118 may comprise other components for mounting the connector 100 to the host circuit board 102. For example, the mounting contacts 118 may be solder tails, socket contacts, or surface mount contacts.

Optionally, the housing 104 may be a multi-piece structure. For example, the housing 104 may include a front shell 130 and a rear shell 132. The mating contact assembly 107 may generally be located in the front shell 130 and the mounting contact assembly 109 may generally be located in the rear shell 132. The rear shell 130 may hold an insulator 134 for positioning the mounting contact assembly 109 in the rear shell 132. For example, the insulator 134 may be potting material or epoxy filling the rear shell 132 after the mounting contact assembly 109 is loaded into the rear shell 132. In other various embodiments, the insulator 134 may be pre-formed and loaded into the rear shell 132 with the mounting contact assembly 109 are after the mounting contact assembly 109 is installed. Optionally, the front shell 130 and/or the rear shell 132 may be metal and may be configured to be electrically grounded. Optionally, the front shell 130 and/or the rear shell 132 may be plastic or another dielectric material. The front shell 130 may be secured to the rear shell 132 using adhesive, epoxy, mechanical fasteners, or other means.

The front shell 130 extends between a front 150 and a rear 152. The front shell 130 includes a flange 154 between the front 150 and the rear 152. The flange 154 may have mounting openings for securing the front shell 130 to the rear shell 132 and/or the circuit board 102. The front shell 130 includes a tongue 156 extending forward of the flange 154. The tongue 156 extends to the front 150 and defines the mating end 106 of the housing 104. The tongue 156 surrounds a portion of the cavity 115. The rear shell 132 extends between a front 160 and a rear 162. The rear shell 132 surrounds a portion of the cavity 115 and may receive a portion of the front shell 130. The mounting contacts 118 extend rearward from the rear 162 of the rear shell 132 and are configured to be press-fit into plated vias of the host circuit board 102.

Figure 6:
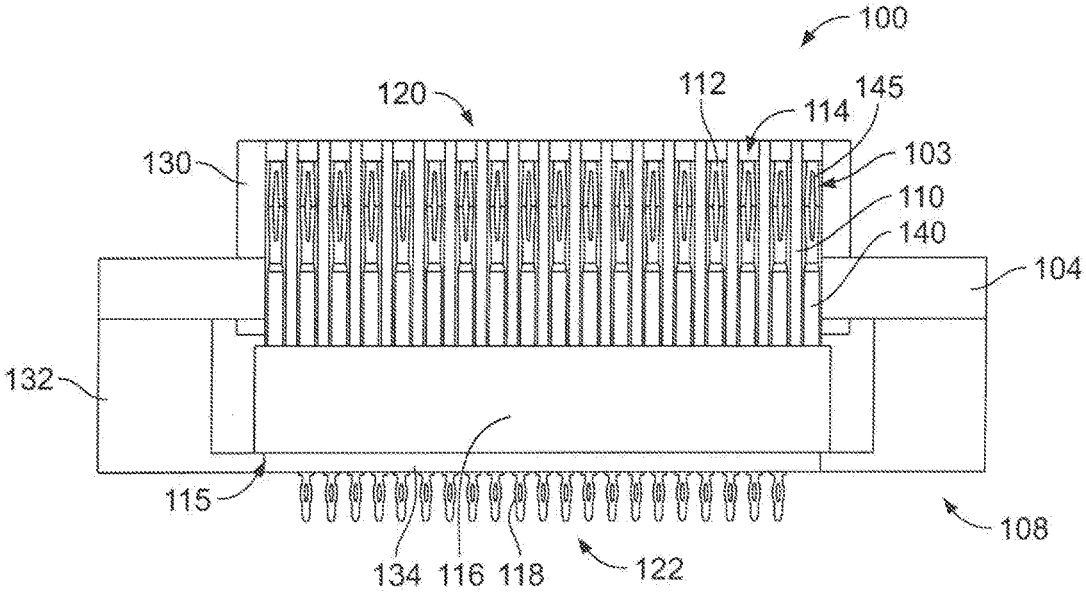
FIG. 6 is a front, partial sectional view of the circuit board connector in accordance with an exemplary embodiment showing the contact assembly.
Figure 7:
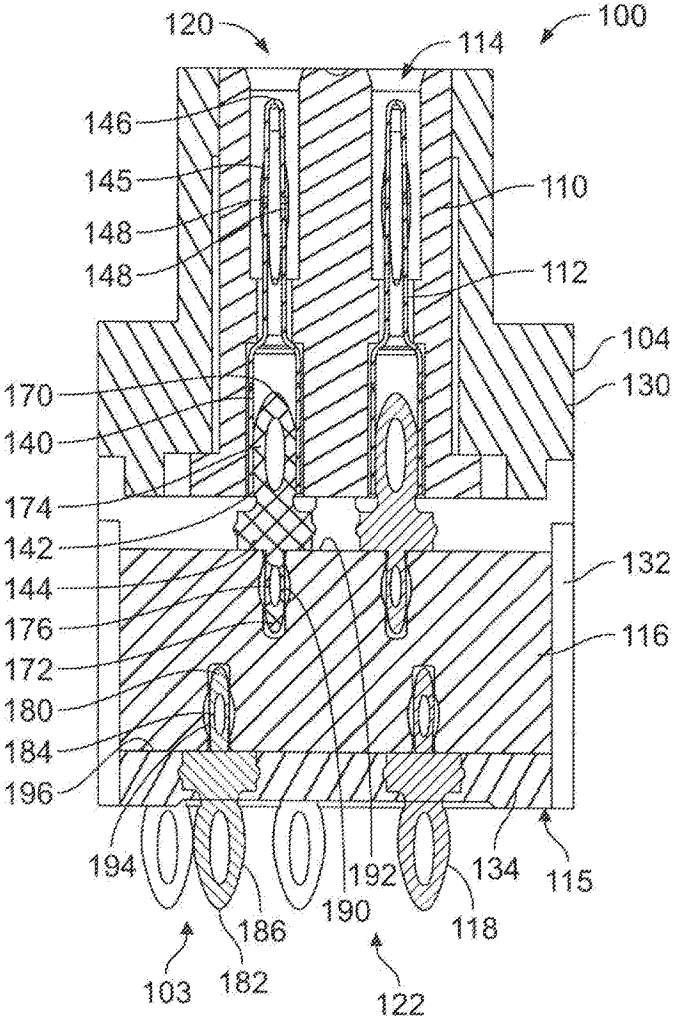
FIG. 7 is a side cross-sectional view of the circuit board connector in accordance with an exemplary embodiment showing the contact assembly.

FIG. 6 is a front, partial sectional view of the circuit board connector 100 in accordance with an exemplary embodiment showing the contact assembly 103. FIG. 7 is a side cross-sectional view of the circuit board connector 100 in accordance with an exemplary embodiment showing the contact assembly 103. The front shell 130 is shown coupled to the rear shell 132. The contact holder 110 is received in the front shell 130 and the mating contacts 112 are shown received in corresponding contact channels 114 of the contact holder 110. The mating contacts 112 are separate and discrete from the mounting contacts 118 and are electrically connected via the interposer circuit board 116, which is received in the cavity 115 of the housing 104. The insulator 134 is provided in the rear shell 132 to seal the mounting end 108 of the housing 104. For example, the insulator 134 may be a heat reflowable polymer layer received in the cavity 115 near the mounting end 108.

In an exemplary embodiment, each mating contact 112 includes a barrel-shaped base 140 at a rear 142 of the mating contact 112. The base 140 is configured to be electrically connected or terminated to the interposer circuit board 116, such as using an interposer contact 144. In an exemplary embodiment, the mating contacts 112 are stamped and formed into the barrel shape; however, the mating contacts 112 may be formed by other processes, such as extrusion, bonding, milling, and the like. In an exemplary embodiment, the mating contact 112 defines a mating pin 145 at a front 146 of the mating contact 112 that is configured to be mated with the mating contact of the mating electrical connector. In an exemplary embodiment, the mating pin 145 includes compliant beams 148 at the front 146. The compliant beams 148 are bowed outward for connection to the mating contact of the mating electrical connector. The compliant beams 148 are deflectable and are configured to be spring biased when mated thereto. Optionally, the compliant beams 148 are stamped and formed with the barrel shaped base 140 as a unitary structure with the base 140.

The interposer contacts 144 each extend between a front 170 and a rear 172. In an exemplary embodiment, the interposer contact 144 includes a connecting pin 174 at the front 170. The connecting pin 174 is compliant and configured for a press-fit mechanical and electrical connection to the base 140 of the mating contact 112. In the illustrated embodiment, the connecting pin 174 is an eye-of-the-needle pin configured to be plugged into the base 140. In an exemplary embodiment, the mounting contact 118 includes a connecting pin 176 at the rear 172. The connecting pin 176 is compliant and configured for a press-fit mechanical and electrical connection to the interposer circuit board 116. In the illustrated embodiment, the connecting pin 176 is an eye-of-the-needle pin configured to be plugged into a plated via of the interposer circuit board 116. In an exemplary embodiment, the interposer contact 144 is stamped and formed to include the eye-of-the-needle shaped connecting pin 174 at the front 170 and the eye-of-the-needle shaped connecting pin 176 at the rear 172.

The mounting contacts 118 each extend between a front 180 and a rear 182. In an exemplary embodiment, the mounting contact 118 includes a connecting pin 184 at the front 180. The connecting pin 184 is compliant and configured for a press-fit mechanical and electrical connection to the interposer circuit board 116. In the illustrated embodiment, the connecting pin 184 is an eye-of-the-needle pin configured to be plugged into a plated via of the interposer circuit board 116. In an exemplary embodiment, the mounting contact 118 includes a mounting pin 186 at the rear 182. The mounting pin 186 is compliant and configured for a press-fit mechanical and electrical connection to the host circuit board 102 (shown in FIG. 1). In the illustrated embodiment, the mounting pin 186 is an eye-of-the-needle pin configured to be plugged into a plated via of the host circuit board 102. In an exemplary embodiment, the mounting contact 118 is stamped and formed to include the eye-of-the-needle shaped connecting pin 184 at the front 180 and the eye-of-the-needle shaped mounting pin 186 at the rear 182. The eye-of-the-needle shaped pins generally include a compliant portion extending to a tip. The compliant portion includes opposing first and second legs surrounding an opening. The legs may be compressed inward into the opening when the compliant portion is press-fit into the corresponding via. The legs may be spring biased outward after the legs are deflected. The mounting contacts 118 may be identical to the interposer contacts 144 and may be formed using the same stamping dies.

In an exemplary embodiment, the interposer circuit board 116 spaces the mounting contacts 118 and the interposer contacts 144 apart at the appropriate spacing to correspond with the pin mating interface 120 and the pin mounting interface 122 (both shown in FIG. 5). The interposer circuit board 116 is a multi-layer circuit board having traces, vias and the like on the various layers to route the circuits between the mating contacts 112 and the mounting contacts 118. For example, the interposer circuit board 116 may transition the signal circuit paths from upper conductors 190 at an upper board surface 192 to lower conductors 194 at a lower board surface 196. The upper conductors 190 are arranged generally in the pin mating interface 120 and the lower conductors 194 are arranged generally in the pin mounting interface 122 (for example, at a different spacing). The upper conductors 190, in the illustrated embodiment, are plated vias and the lower conductors 194, in the illustrated embodiment, are plated vias; however, the conductors 190, 194 may be other types of conductors in alternative embodiments, such as pads, traces and the like.

Figure 8:
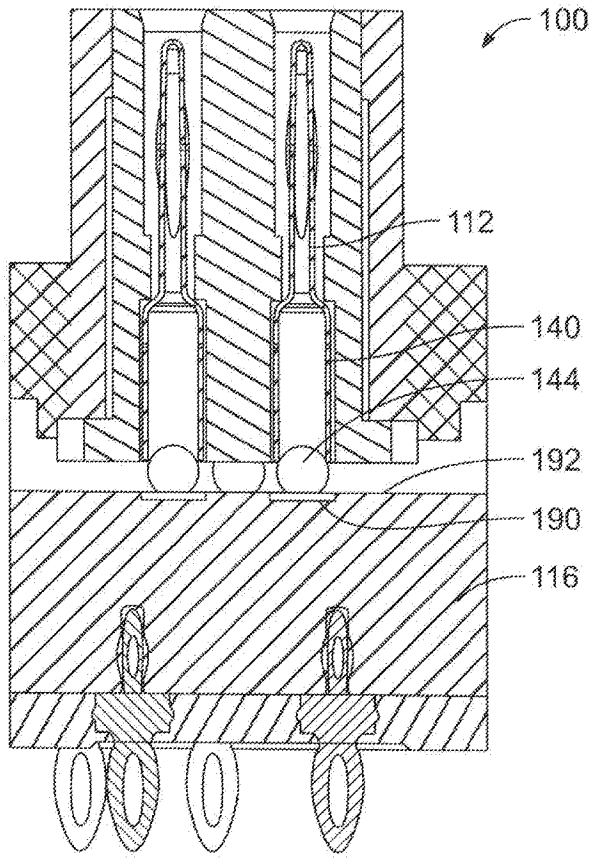
FIG. 8 is a partial sectional view of the circuit board connector in accordance with an exemplary embodiment.

FIG. 8 is a partial sectional view of the circuit board connector 100 in accordance with an exemplary embodiment. The circuit board connector 100 uses the interposer contacts 144 between the mating contacts 112 and the interposer circuit board 116. In the illustrated embodiment, the interposer contacts 144 are solder contacts rather than double-ended compliant contacts. For example, in the illustrated embodiment, the solder contacts are solder balls between the bases 140 and the interposer circuit board 116. The solder balls electrically connect the bases 140 to corresponding upper conductors 190 on the upper board surface 192, which are solder pads.

Figure 9:
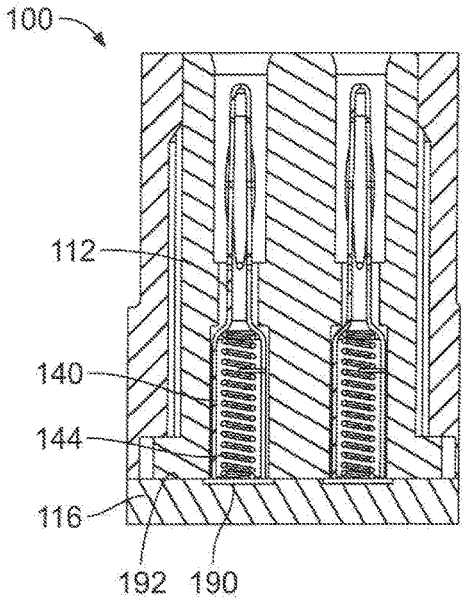
FIG. 9 is a partial sectional view of the circuit board connector in accordance with an exemplary embodiment.

FIG. 9 is a partial sectional view of the circuit board connector 100 in accordance with an exemplary embodiment. The circuit board connector 100 uses the interposer contacts 144 between the mating contacts 112 and the interposer circuit board 116. In the illustrated embodiment, the interposer contacts 144 are coil springs received in the bases 140. The coil springs electrically connect the bases 140 to corresponding upper conductors 190 on the upper board surface 192, which are surface pads.

Figure 10:
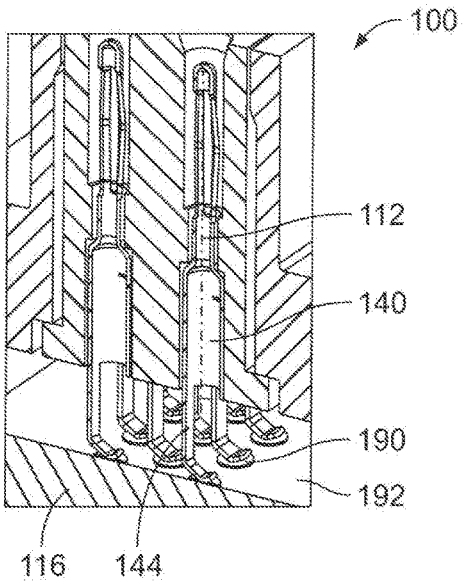
FIG. 10 is a partial sectional view of the circuit board connector in accordance with an exemplary embodiment.

FIG. 10 is a partial sectional view of the circuit board connector 100 in accordance with an exemplary embodiment. The circuit board connector 100 uses the interposer contacts 144 between the mating contacts 112 and the interposer circuit board 116. In the illustrated embodiment, the interposer contacts 144 are spring beams extend below the rear of the bases 140. The spring beams of the interposer contacts 144 are integral with the bases 140 of the mating contacts 112. The spring beams electrically connect the bases 140 to corresponding upper conductors 190 on the upper board surface 192, which are surface pads using solder.

Figure 11:
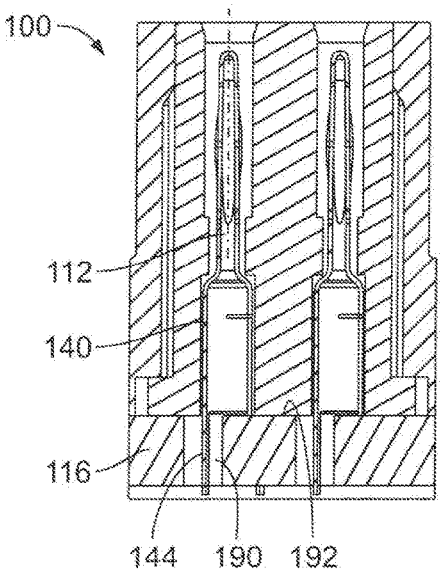
FIG. 11 is a partial sectional view of the circuit board connector in accordance with an exemplary embodiment.

FIG. 11 is a partial sectional view of the circuit board connector 100 in accordance with an exemplary embodiment. The circuit board connector 100 uses the interposer contacts 144 between the mating contacts 112 and the interposer circuit board 116. In the illustrated embodiment, the interposer contacts 144 are solder tails extend below the rear of the bases 140. The solder tails of the interposer contacts 144 are integral with the bases 140 of the mating contacts 112. The solder tails electrically connect the bases 140 to corresponding upper conductors 190 on the upper board surface 192, which are plated vias that may be filled with solder.

Figure 12:
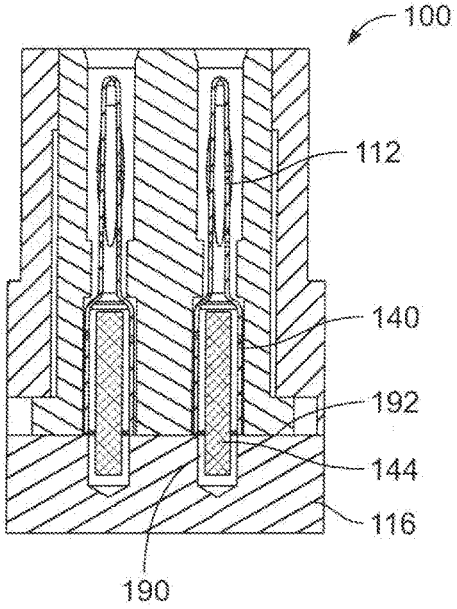
FIG. 12 is a partial sectional view of the circuit board connector in accordance with an exemplary embodiment.

FIG. 12 is a partial sectional view of the circuit board connector 100 in accordance with an exemplary embodiment. The circuit board connector 100 uses the interposer contacts 144 between the mating contacts 112 and the interposer circuit board 116. In the illustrated embodiment, the interposer contacts 144 are solder tails extending below the rear of the bases 140. The solder tails of the interposer contacts 144 are discrete from the bases 140 of the mating contacts 112. For example, the solder tails may be wires received in the bases 140 and the bases 140 may be crimped to the wires. The solder tails electrically connect the bases 140 to corresponding upper conductors 190 on the upper board surface 192, which are plated vias that may be filled with solder.

Figure 13:
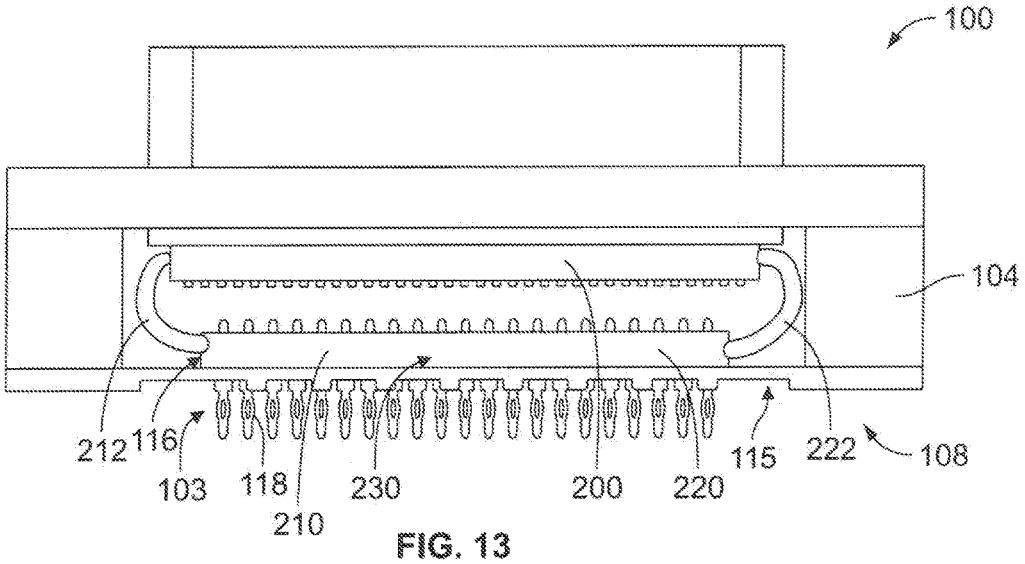
FIG. 13 is a partial sectional view of the circuit board connector including the contact assembly in accordance with an exemplary embodiment.
Figure 14:
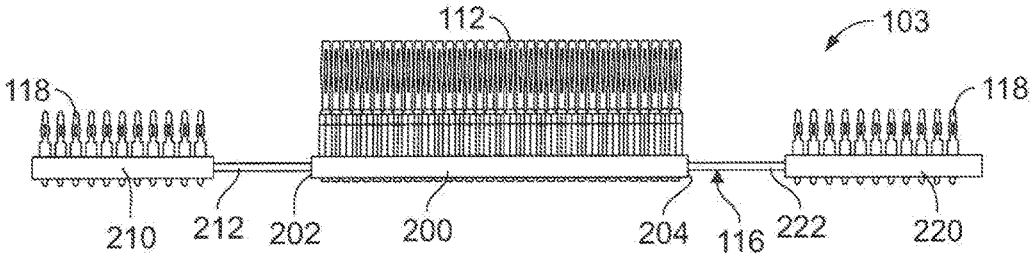
FIG. 14 is a side view of the contact assembly in accordance with an exemplary embodiment.
Figure 15:
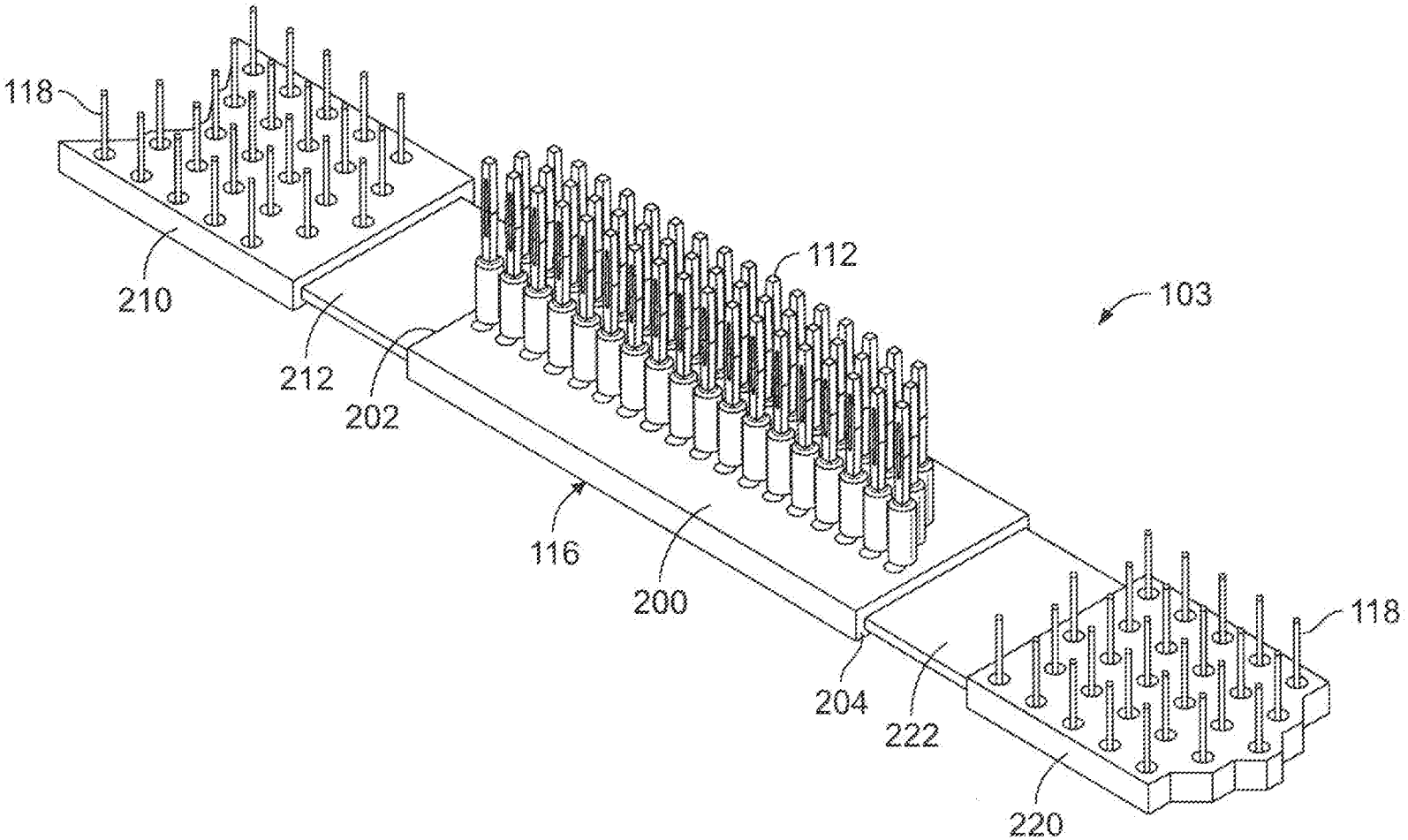
FIG. 15 is a top perspective view of the contact assembly in accordance with an exemplary embodiment.

FIG. 13 is a partial sectional view of the circuit board connector 100 including the contact assembly 103 in accordance with an exemplary embodiment. FIG. 14 is a side view of the contact assembly 103 in accordance with an exemplary embodiment. FIG. 15 is a top perspective view of the contact assembly 103 in accordance with an exemplary embodiment.

The contact assembly 103 includes the interposer circuit board 116, which, in the illustrated embodiment, includes flexible circuits. In an exemplary embodiment, the interposer circuit board 116 includes a rigid upper circuit board 200 having a first end 202 and a second end 204. The interposer circuit board 116 includes a rigid first circuit board portion 210 and a first flexible circuit 212 between the first end 202 of the upper circuit board 200 and the first circuit board portion 210. The interposer circuit board 116 includes a rigid second circuit board portion 220 and a second flexible circuit 222 between the second end 204 of the upper circuit board 200 and the second circuit board portion 220. The first and second circuit board portions 210, 220 are wrapped under the upper circuit board 200 by bending the first and second flexible circuits 212, 222. The first and second circuit board portions 210, 220 may be joined together to form a lower circuit board 230 below the upper circuit board 200.

The mounting contacts 118 are electrically connected or terminated to the lower circuit board 230. For example, the mounting contacts 118 may be press-fit into the lower circuit board 230. The mating contacts 112 are electrically connected or terminated to the upper circuit board 200. For example, the mating contacts 112 may be press-fit into the upper circuit board 200. Once assembled, the contact assembly 103 may be loaded into the housing 104, such as into the cavity 115. The mating contacts 112 are loaded into the contact holder 110 (shown in FIG. 1). The contact assembly 103 is positioned in the housing 104 such that the mounting contacts 118 extend from the mounting end 108. The cavity 115 may be filled with a potting material, an epoxy material, or another type of insulator to fix the mounting contacts 118 in the housing 110.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A press-fit circuit board connector comprising:

a housing having a mating end and a mounting end opposite the mating end configured to be mounted to a host circuit board, the housing having a cavity between the mating end and the mounting end;

a mating contact assembly having a mating contact holder including a plurality of contact channels and a plurality of mating contacts received in corresponding contact channels, the mating contacts having mating pins at mating ends of the mating contacts, the mating contact assembly received in the cavity of the housing positioning the mating pins at the mating end to define a pin mating interface for mating with an electrical connector; and a mounting contact assembly having an interposer circuit board and a plurality of mounting contacts electrically connected to the interposer circuit board at corresponding circuits of the interposer circuit board, the mating contacts being electrically connected to corresponding circuits of the interposer circuit board to electrically connect the mating contacts and the mounting contacts via the interposer circuit board, the mounting contacts having press-fit mounting pins at mounting ends of the mounting contacts, the interposer circuit board received in the cavity with the press-fit mounting pins of the mounting contacts arranged at the mounting end for press-fit termination to the host circuit board;

wherein the mating pins of the mating contacts are arranged at the pin mating interface having a first pattern and wherein the press-fit mounting pins of the mounting contacts are arranged at the mounting end to define a pin mounting interface having a second pattern different than the first pattern;

wherein the first pattern arranges the mating pins in three rows and the second pattern arranges the press-fit mounting pins in more than three rows.

2. The circuit board connector of claim 1, wherein the mating pins are arranged in rows and in columns, the mating pins having a mating pin pitch to the nearest adjacent mating pin, the mounting pins arranged in rows and in columns, the mounting pins having a mounting pin pitch to the nearest adjacent mating pin, the mounting pin pitch being further than the mating pin pitch.

3. The circuit board connector of claim 1, wherein the interposer circuit board includes a rigid upper circuit board, a rigid lower circuit board and a flexible circuit between the upper circuit board and the lower circuit board, the mounting contacts being electrically connected to the lower circuit board, the mating contacts being electrically connected to the upper circuit board, the flexible circuit electrically connecting the mating contacts electrically connected to the upper circuit board with corresponding mounting contacts electrically connected to the lower circuit board.

4. The circuit board connector of claim 1, wherein the interposer circuit board includes a rigid upper circuit board having a first end and a second end, a rigid first circuit board portion, a first flexible circuit between the first end of the upper circuit board and the first circuit board portion, a rigid second circuit board portion and a second flexible circuit between the second end of the upper circuit board and the second circuit board portion, the first and the second circuit board portions being wrapped under the upper circuit board and being joined together to form a lower circuit board below the upper circuit board, the mounting contacts being electrically connected to the lower circuit board, the mating contacts being electrically connected to the upper circuit board.

5. The circuit board connector of claim 1, wherein the interposer circuit board is a rigid circuit board having a plurality of layer and having an upper board surface and a lower board surface, the mounting contacts being electrically connected to the lower board surface, the mating contacts being electrically connected to the upper board surface.

6. The circuit board connector of claim 1, wherein the press-fit mounting pins are first press-fit mounting pins, the mounting contacts having second press-fit mounting pins opposite the first press-fit mounting pins, the second press-fit mounting pins being electrically connected to the interposer circuit board.

7. The circuit board connector of claim 1, wherein the mating contacts have press-fit pins at interposer ends of the mating contacts opposite the mating pins at the mating ends of the mating contacts, the press-fit pins being electrically connected to plated vias of the interposer circuit board.

8. The circuit board connector of claim 1, wherein the mating contacts have spring beams at interposer ends of the mating contacts opposite the mating pins at the mating ends of the mating contacts, the spring beams being surface mounted to interposer pads on an upper board surface of the interposer circuit board.

9. The circuit board connector of claim 1, wherein the mating contacts have solder tails at interposer ends of the mating contacts opposite the mating pins at the mating ends of the mating contacts, the solder tails being electrically connected to the interposer circuit board.

10. The circuit board connector of claim 1, wherein the mating contacts have receptacles at interposer ends of the mating contacts opposite the mating pins at the mating ends of the mating contacts, the receptacles receiving springs therein configured to be spring biased against interposer pads on an upper board surface of the interposer circuit board.

11. A press-fit circuit board connector comprising:

a housing having a mating end and a mounting end opposite the mating end configured to be mounted to a host circuit board, the housing having a cavity between the mating end and the mounting end;

a mounting contact assembly received in the cavity, the mounting contact assembly having an interposer circuit board including an upper board surface and a lower board surface, the mounting contact assembly having a plurality of mounting contacts electrically connected to the lower board surface of the interposer circuit board at corresponding circuits of the interposer circuit board, the mounting contacts having press-fit mounting pins at mounting ends of the mounting contacts for press-fit termination to the host circuit board; and a mating contact assembly received in the cavity, the mating contact assembly having a mating contact holder including a plurality of contact channels, the mating contact assembly having a plurality of mating contacts received in corresponding contact channels, the mating contacts having mating pins at mating ends of the mating contacts for mating with an electrical connector, the mating contacts having terminating ends opposite the mating pins being electrically connected to the upper board surface of the interposer circuit board at corresponding circuits of the interposer circuit board to electrically connect the mating contacts and the mounting contacts via the interposer circuit board;

wherein the press-fit mounting pins are first press-fit mounting pins, the mounting contacts having second press-fit mounting pins opposite the first press-fit mounting pins, the second press-fit mounting pins being electrically connected to the interposer circuit board.

12. The circuit board connector of claim 11, wherein the mating pins of the mating contacts are arranged at a pin mating interface having a first pattern and wherein the press-fit mounting pins of the mounting contacts are arranged at the mounting end to define a pin mounting interface having a second pattern different than the first pattern.

13. The circuit board connector of claim 11, wherein the interposer circuit board includes a rigid upper circuit board, a rigid lower circuit board and a flexible circuit between the upper circuit board and the lower circuit board, the mounting contacts being electrically connected to the lower circuit board, the mating contacts being electrically connected to the upper circuit board, the flexible circuit electrically connecting the mating contacts electrically connected to the upper circuit board with corresponding mounting contacts electrically connected to the lower circuit board.

14. The circuit board connector of claim 11, wherein the mating contacts have press-fit pins at interposer ends of the mating contacts opposite the mating pins at the mating ends of the mating contacts, the press-fit pins being electrically connected to plated vias of the interposer circuit board.

15. A press-fit circuit board connector comprising:

a housing having a mating end and a mounting end opposite the mating end configured to be mounted to a host circuit board, the housing having a cavity between the mating end and the mounting end;

a mounting contact assembly received in the cavity, the mounting contact assembly having an interposer circuit board comprising an upper circuit board, a lower circuit board and a flexible circuit between the upper circuit board and the lower circuit board, the mounting contact assembly having a plurality of mounting contacts electrically connected to the lower circuit board, the mounting contacts having press-fit mounting pins at mounting ends of the mounting contacts for press-fit termination to the host circuit board; and a mating contact assembly received in the cavity, the mating contact assembly having a plurality of mating contacts having mating pins at mating ends of the mating contacts for mating with an electrical connector and terminating ends opposite the mating pins electrically connected to the upper circuit board, the flexible circuit electrically connecting the mating contacts electrically connected to the upper circuit board with corresponding mounting contacts electrically connected to the lower circuit board.

16. The circuit board connector of claim 15, wherein the mating pins of the mating contacts are arranged at a pin mating interface having a first pattern and wherein the press-fit mounting pins of the mounting contacts are arranged at the mounting end to define a pin mounting interface having a second pattern different than the first pattern.

17. The circuit board connector of claim 15, wherein the upper circuit board has a first end and a second end, the lower circuit board having a rigid first circuit board portion and a rigid second circuit board portion, the flexible circuit having a first flexible circuit between the first end of the upper circuit board and the first circuit board portion and a second flexible circuit between the second end of the upper circuit board and the second circuit board portion, the first and the second circuit board portions being wrapped under the upper circuit board and being joined together to form the lower circuit board below the upper circuit board.

* * * * *